United States Patent [19]

Fischer et al.

[11] Patent Number: 5,050,258

[45] Date of Patent: Sep. 24, 1991

[54] METHOD AND APPARATUS FOR CONTROLLING COLOR DISTRIBUTION IN A TEXTILE DYEING PROCESS

[75] Inventors: Rüdiger Fischer, Düsseldorf; Kurt van Wersch, Wegberg, both of Fed. Rep. of Germany

[73] Assignee: A. Monforts GmbH & Co., Monchengladbach, Fed. Rep. of Germany

[21] Appl. No.: 558,074

[22] Filed: Jul. 25, 1990

[30] Foreign Application Priority Data

Aug. 1, 1989 [DE] Fed. Rep. of Germany ..... 3925444

[51] Int. Cl.[5] ..... D06B 15/02; D06B 23/26

[52] U.S. Cl. ..... 8/151; 8/158; 68/13 R; 68/22 R; 118/665; 118/672

[58] Field of Search ..... 8/151, 158; 68/13 R, 68/22 R; 118/665, 672

[56] References Cited

U.S. PATENT DOCUMENTS

| | | | |
|---|---|---|---|
| 3,207,125 | 9/1965 | Strandberg, Jr. | 118/665 |
| 3,995,478 | 12/1976 | Wilhelm, Jr. | 118/665 X |
| 4,135,006 | 1/1979 | Readal et al. | 118/665 X |
| 4,157,595 | 6/1979 | Von Der Eltz et al. | 8/158 X |
| 4,620,338 | 11/1986 | Von Der Eltz et al. | 8/151 |

FOREIGN PATENT DOCUMENTS

| | | |
|---|---|---|
| 3615579C1 | 7/1987 | Fed. Rep. of Germany . |
| 3615580C1 | 7/1987 | Fed. Rep. of Germany . |
| 621225G | 1/1981 | Switzerland . |

OTHER PUBLICATIONS

Dr.-Ing. Ruediger Fischer, Ein neuer Foulard zum Faerben, Appretieren und Impraegnieren, Dec. 1988.

Dr. Hellmut Beckstein, Kontrolle von Abquetscheffekt und Flottenauftrag, Oct. 1986.

*Primary Examiner*—Philip R. Coe

*Attorney, Agent, or Firm*—Shefte, Pinckney & Sawyer

[57] ABSTRACT

A method and apparatus is provided for controlling the distribution of color on a web of textile material in a textile dyeing process. The apparatus includes a color sensor for sensing a selected color characteristic of the textile web, such as, for example, the distribution of color, at a sensing location downstream of a nip device of a textile padding machine. The nip device removes excess dye liquor from the textile web to dispose the textile web at an initial moisture content as it exits the textile padding machine. The amount of the dye liquor removal through the nip operation is controlled in response to the color characteristic sensed by the color sensor so that the textile web is disposed at an initial moisture content upon exiting the textile padding machine which facilitates a desired color distribution when the textile web is subsequently dried.

17 Claims, 1 Drawing Sheet

METHOD AND APPARATUS FOR CONTROLLING COLOR DISTRIBUTION IN A TEXTILE DYEING PROCESS

BACKGROUND OF THE INVENTION

The present invention relates to a method and apparatus for controlling the distribution of color on a textile web in a textile dyeing process.

In one known textile dyeing process, dye liquor is applied to a continuously traveling textile web by a textile padding machine. The textile padding machine includes a nip device, such as a pair of cooperating nip rollers for performing a nip operation to remove excess dye liquor and thereby control the amount of dye liquor pick up by the textile web. The traveling textile web exiting the textile padding machine has an initial moisture content which influences the eventual distribution of the color on the textile web.

In a textile dyeing process in which the textile web is to be uniformly dyed in a single color, it is especially desirable that the color distribution be as uniform as possible. In this regard, it is desirable that the color distribution be such that the color along the center of the traveling textile web be as identical as possible to the color more closely adjacent the edges of the textile web. It has been proposed to measure the moisture content of the traveling textile web following the nip operation at locations relative to the center and edge portions of the textile web. Moreover, it is known to control the nip operation in response to the measurement of the moisture content of the textile web following the nip operation. In practice, however, the distribution of color on the textile web following the textile dyeing process may be uneven despite the fact that the moisture content of the traveling textile web is substantially uniform immediately following the nip operation. This uneven distribution of color can result from different adsorption capacities of different portions of the textile web, variations in the thickness of the textile web and variations in the pre-treatment of the textile web, especially in the situation in which the textile web has been bleached prior to the textile dyeing process.

To prevent the occurrence of an uneven distribution of color, it is known to conduct a test run of a sample of the textile web to determine the color distribution characteristics of the textile web prior to the handling of the balance of the textile web. However, the travel path along which the traveling textile web is moved in the textile dyeing process can be of significant length, and can even exceed 100 meters, so that a relatively significantly large amount of textile web must be processed in the test run. The tested material must necessarily be discarded after the test run, thereby correspondingly adding to the production costs of the textile dyeing process. Another drawback of the running of a test sample of the textile web is that the test sample may not necessarily be representative of the balance of the textile web so that the adjustments of the textile padding machine indicated by the test run may not be appropriate for the actual production run of the balance of the textile web through the textile dyeing process.

Even if the test run provides accurate adjustment values for the textile padding machine, slight color variations of certain portions of the textile web ma not be noticeable until the textile dyeing process is complete and, in this event, it is often necessary to inspect the finished, dyed textile web to locate and/or identify those portions of the textile web which vary from the desired color distribution. Accordingly, the need exists for a method and apparatus for providing feedback relating to the color distribution on a textile web during a textile dyeing process so that corrective action can be taken to minimize uneven color distribution in the finished textile web.

SUMMARY OF THE INVENTION

The present invention provides a sensor for sensing a color characteristic of a textile web subsequent to its passage through a nip device, and means for controlling the nip device in response to the sensed color characteristic, to effect adjustment of dye liquor pickup and thereby minimize uneven color distribution in the finished textile web.

Briefly described, the present invention provides an improvement in a textile dyeing process in which a textile web continuously travels through a textile padding machine for the application of dye liquor with the initial dye liquor pick up being controlled by a nip device that removes excess dye liquor from the textile web, resulting in an initial moisture content in the textile web. The improvement includes sensing a color characteristic of the textile web following the removal of excess dye liquor from the textile web portion by the nip device and controlling the operation of the nip device in response to the color characteristic sensing to control the liquor pick up and thereby control the initial moisture content for desired color distribution on the textile web.

According to one aspect of the present invention, the color characteristic sensing includes sensing the distribution of color on the textile web. In one form of the one aspect of the present invention, the color distribution sensing includes sensing the color distribution on the textile web at a plurality of sensing locations located across the traveling textile web.

In a textile dyeing process wherein the nip device is controlled to dispose the initial moisture content of the textile web at a predetermined value. The improvement of the present invention includes, in one variation thereof, adjusting the initial moisture content in response to the color characteristic sensing.

According to another variation of the one aspect of the present invention, the color distribution sensing includes sensing the absolute color distribution on the textile web. According to a further variation of the one aspect of the present invention, the color distribution sensing includes sensing the relative color distribution on the textile web. The further variation of the one aspect of the present invention includes the feature that sensing the relative color distribution on the textile web includes sensing the color distribution at a plurality of sensing locations located across the traveling textile web and comparing the relative color distributions sensed at the sensing locations, and controlling the operation of the nip device includes controlling the distribution of the dye liquor pick up across the traveling web.

According to yet another aspect of the improvement of the present invention in which, in a textile dyeing process a computer is operatively connected to the textile padding machine and a color sensor for sensing the color characteristic is operatively connected to the computer, the adjusting the initial moisture content includes sensing the textile web with the color sensor and transmitting a signal from the color sensor to the computer to prompt the computer to control the nip device to effect adjustment of the initial moisture content of the textile web from the predetermined initial moisture content.

According to yet another aspect of the improvement of the present invention, the improvement includes storing information by the computer relating to the occurrences of predetermined sensed color characteristics of the textile web, the stored information being retrievable to identify those portions of the textile web having the predetermined sensed color characteristics.

The present invention also provides a feedback control system for a textile dyeing arrangement having a textile padding machine for applying dye liquor to a textile web continuously traveling therethrough with the initial dye liquor pick up being controlled by a nip device that removes excess dye liquor from the textile web, resulting in an initial moisture content in the textile web. The feedback control system includes means for sensing a color characteristic of the textile web following the removal of excess dye liquor from the textile web portion by the nip device and means for controlling the operation of the nip device in response to the color characteristic sensing to control the liquor pick up and thereby control the initial moisture content for desired color distribution on the textile web.

According to one aspect of the feedback control system of the present invention, the color characteristic sensing means includes means for sensing the distribution of color on the textile web. In one form of the one aspect of the feedback control system, the color distribution sensing means includes means for sensing the color distribution on the textile web at a plurality of sensing locations located across the traveling textile web.

In a textile dyeing arrangement, wherein the nip device is controlled to dispose the initial moisture content of the textile web at a predetermined value, the one aspect of the feedback control system comprises the feature that the means for controlling the operation of the nip device includes means for adjusting the initial moisture content in response to the color characteristic sensing. In one variation of the one aspect of the present invention, the color distribution sensing means includes means for sensing the absolute color distribution on the textile web.

According to one feature of the one aspect of the feedback control system, the color distribution sensing means includes means for sensing the relative color distribution on the textile web. In a further feature, the means for sensing the relative color distribution on the textile web includes means for sensing the color distribution at a plurality of sensing locations located across the traveling textile web and means for comparing the relative color distributions sensed at the sensing locations, and the means for controlling the operation of the nip device includes means for controlling the distribution of the dye liquor pick up across the traveling web.

According to yet another aspect of the feedback control system of the present invention, a computer is operatively connected to the textile padding machine and the means for adjusting the initial moisture content includes a color sensor operatively connected to the computer for transmitting a signal from the color sensor to the computer to prompt the computer to control the nip device to effect adjustment of the initial moisture content of the textile web from the predetermined initial moisture content.

DETAILED DESCRIPTION OF THE PREFERRED EMBODIMENT

Figure 1:
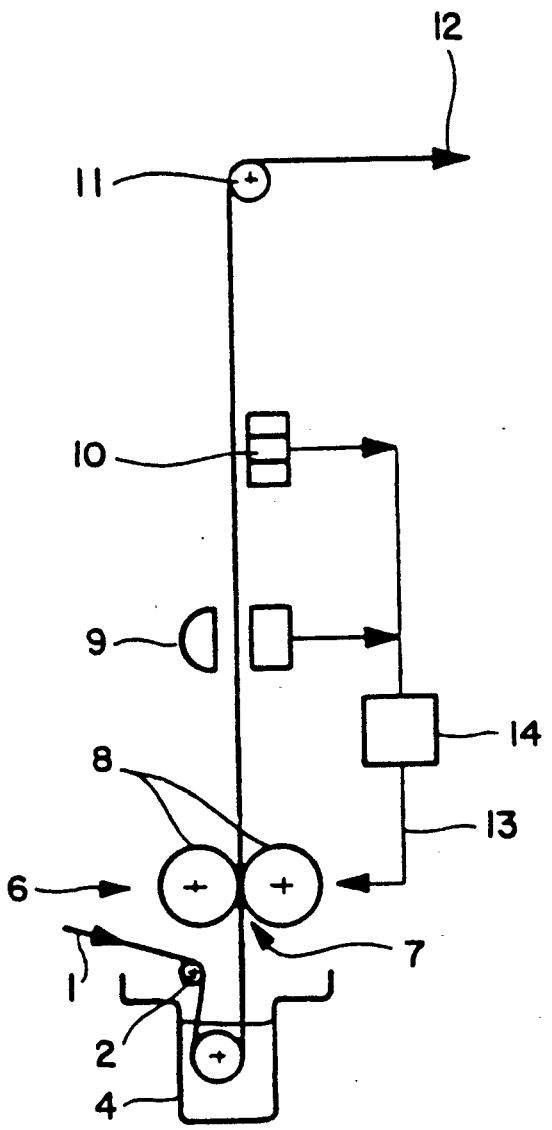
FIG. 1 is a schematic side elevational view of an assembly for performing a textile dyeing process including a textile padding machine and incorporating the preferred embodiment of the textile dyeing feedback apparatus of the present invention.
Figure 2:
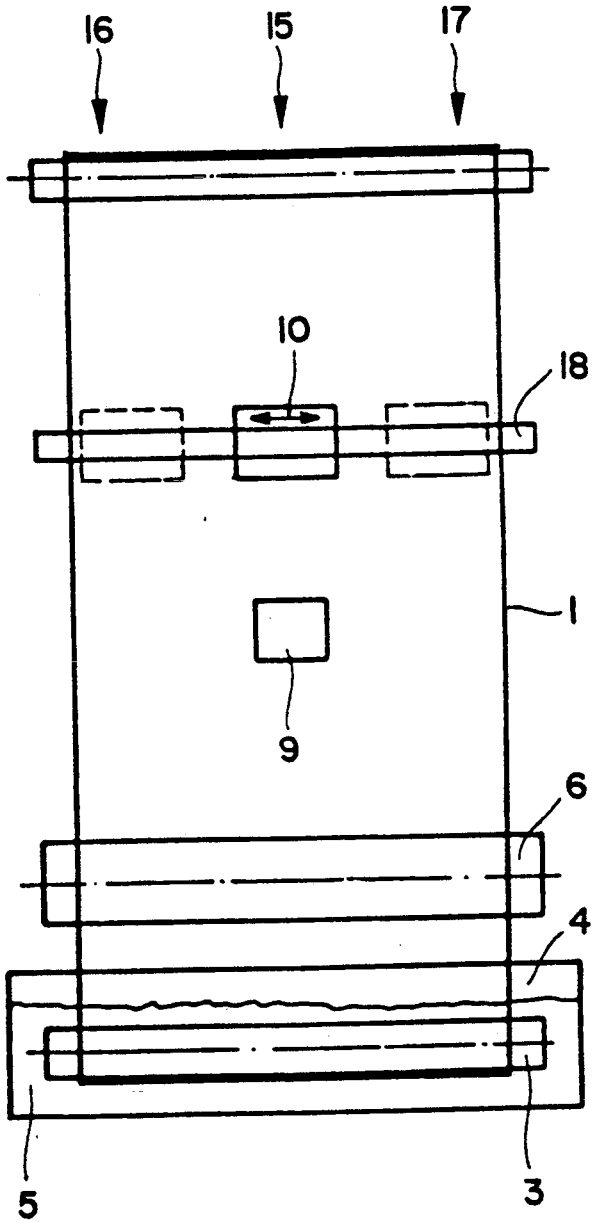
FIG. 2 is a plan view of the textile dyeing assembly shown in FIG. 1.

In FIGS. 1 and 2, the preferred embodiment of the textile dyeing apparatus of the present invention is illustrated. A conventional textile dyeing assembly for handling a continuously traveling textile web 1 comprises a textile padding machine which includes a guide roller 2, shown in FIG. 1, extending transversely to the travel path of the textile web 1 and positioned above a dye liquor container 4 which contains a bath 5 of dye liquor. An immersion roller 3 is positioned downstream of the guide roller 2 and extends transversely to the travel path of the textile web 1. The immersion roller 3 is at least partially submerged in the dye liquor bath 5.

A nip device 6 includes a pair of cooperating nip rollers 8 which cooperate together to form a nip 7 through which the textile web 1 travels after its passage through the dye liquor bath 5. A further guide roller 11 is positioned downstream of the nip device and extends transversely to the travel path of the textile web 1.

The textile web 1 is trained around the guide roller 2, the immersion roller 3 and the further guide roller 11 for guiding travel of the textile web 1 during the textile dyeing process in imparting color to the textile web 1. The textile web 1 then travels in the direction indicated by the arrow 12 in FIG. 1 to a further handling location such as, for example, a wetting system, a drying system and/or other conventional post-dyeing treatment systems.

The initial moisture content of the textile web 1 as it exits the textile padding machine (i.e.—immediately after the textile web 1 passes through the nip 7) influences the distribution of color at which the textile web 1 ultimately sets after it has passed, for example, through a conventional drying system.

The textile dyeing apparatus of the present invention is in the form of a feedback control system that includes a means for sensing a color characteristic of the textile web 1 following the removal of excess dye liquor from the textile web by the nip device 6. The color characteristic sensing means is preferably in the form of a conventional color sensor 10. As seen in FIG. 2, the color sensor 10 is operable to sense a color characteristic of the textile web 1 traveling therepast and is positioned downstream of the nip device 6 at a relatively closely adjacent spacing thereto preferably in the range of no more than several meters such as, for example, no more than two meters.

The feedback control system additionally includes means for controlling the nip device 6 in response to the sensing of a color characteristic by the color sensor 10. The nip device controlling means includes a conventional data processing device or computer 14 operatively connected to the color sensor 10 to receive signals therefrom and operatively connected via a connector 13 to the nip device 6 to transmit operational signals to the nip device 6 for controlling the operation thereof.

As seen in FIG. 2, the color sensor 10 is preferably operable to sense a color characteristic of the textile web 1 at a plurality of sensing locations across the traveling textile web 1. The plurality of sensing locations are illustrated by the broken line and solid line boxes on the transverse rail 18 shown in FIG. 2. In this regard, a transverse rail 18 can be provided on which the color sensor 10 can be movably mounted for transverse movement among the sensing locations. Each sensing location is located relative to the textile web 1 for sensing of the textile web at a respective one of a side region 16 thereof extending adjacent one lateral side of the textile web, a side region 17 for sensing of the textile web extending adjacent the other lateral side of the textile web and a center region 15 for sensing the textile web generally along its central extent relative to its direction of travel. The color sensor 10 can alternatively be configured as a plurality of separate sensing components, each disposed for sensing the textile web 1 at a respective one of the side regions 16, 17 or the center region 15 with the separate sensing components fixedly mounted to the transverse rail 18.

The operation of the textile dyeing apparatus of the present invention is as follows. The textile web 1 is traveled in conventional manner around the guide roller 2 and is immersed in the dye liquor bath 5 in the dye liquor container 4 during its travel in engagement with the immersion roller 3. The textile web 1 emerges from the dye liquor container 4 with an application of the dye liquor thereon and enters the nip 7 between the nip rollers 8 at which excess dye liquor is removed due to the nipping action of the cooperating nip rollers 8. The textile web emerges from the nip 7 with a pick up of dye liquor that results in an initial moisture content and continues its travel downstream past the color sensor 10.

The color sensor 10 is operated to sense a color characteristic of the textile web traveling therepast. For example, the color sensor 10 can be configured to sense the intensity of color of the textile web at each of the plurality of sensing locations. The sensing by the color sensor 10 can be of the type in which relative color intensity or changes in color intensity is sensed and a corresponding signal is transmitted from the color sensor 10 to the computer 14 corresponding to the sensed color characteristic. The color sensor 10 can alternatively be configured to sense the absolute intensity of color and transmit a signal to the computer 14 corresponding to the absolute intensity of the color sensed. The computer 14 can then sense the differences between the signals transmitted by the color sensor 10 at each of the sensing locations to relatively compare the sensed color characteristic at each sensing location.

The computer 14 accordingly receives a sensing signal from the color sensor 10 corresponding to the sensing of a color characteristic by the color sensor at each of the plurality of sensing locations at the side regions 16, 17 and the center region 15 of the textile web 1. The computer 14 processes the signals received from the color sensor 10 and controls the nip device 6 to effect relative movement of the nip rollers 8 to correspondingly adjust the width of the nip 7 as measured transversely to the direction of travel of the textile web 1.

If the width of the nip 7 is uniform in the direction transverse to the direction of travel of the textile web 1, the relative movement of the nip rollers 8 may be arranged such that only the magnitude of the width of the nip 7 is changed with the width being uniform across the traveling web. As the nip 7 is adjusted to relatively greater widths, the relative amount of the dye liquor removed from the textile web 1 in the nip operation correspondingly decreases. Conversely, as the width of the nip 7 is adjusted to relatively smaller widths, the relative amount of the dye liquor removed from the textile web 1 during the nip operation correspondingly increases. In this manner, the computer 14 controls the relative width of the nip 7 in response to the information received from the color sensor 10 to thereby control, by removal of excess dye liquor, the amount of dye pick up by the portion of the textile web which trails the portion of the textile web sensed by the color sensor 10 in response to the sensing of a color characteristic of the leading textile web portion. The computer 14 can accordingly control the relative width of the nip 7 to remove an appropriate amount of excess dye liquor from the trailing textile web portion so as to dispose the trailing textile web portion at an initial moisture content which facilitates a desired distribution of color on the trailing textile portion. Additionally, the nip device 6 can be of a type, such as disclosed in European Patent No. 49,798 and in U.S. Pat. No. 4,440,012, that is adjustable widthwise of the traveling web to change the relative spacing across the web and thereby adjust dye liquor pick up across the width of the traveling textile web 1 to a uniform amount in response to the relative color intensity sensings by the sensors at the center 15 and side regions 16 and 17.

Since the color sensor 10 is positioned at a location downstream of the nip 7 and relatively closely adjacent thereto, the color sensing information provided by the color sensor 10 advantageously provides feedback in a relatively rapid manner for adjusting the degree of dye liquor removal from the textile web 1 during the nip operation. This feedback operation makes it possible to adjust the initial moisture content of the textile web 1 to an appropriate value before a relatively significant length of the textile web 1 has already passed through the nip 7.

To further maximize the extent of the textile web 1 which exits the nip operation at an initial moisture content which is appropriate for a desired color distribution, the present invention contemplates that the nip 7 can be initially adjusted to a selected width such that the textile web 1 exits the nip 7 at a predetermined initial moisture content. The predetermined initial moisture content can be based upon, for example, empirical results or practical experience which indicate the most appropriate initial moisture content of the textile web 1 based upon its characteristics such as, for example, its thickness. The leading end portion of the textile web 1 will therefore exit the nip 7 at the predetermined initial moisture content and the computer 14 can almost immediately thereafter evaluate the appropriateness of the predetermined initial moisture content based upon color sensing information provided by the color sensor 10. The computer 14 can then selectively adjust the nip 7 from its selected width in response to the color sensing information provided by the color sensor 10.

In a modification of the preferred embodiment of the feedback control system of the present invention, a moisture sensing means in the form of a conventional moisture sensor 9 can be provided to supplement the sensing information provided by the color sensor 10. The moisture sensor 9 is operatively connected to the computer 14 and can be positioned upstream or downstream of the color sensor 10 relative to the direction of travel of the textile web 1. For example, as shown in FIGS. 1 and 2, the moisture sensor 9 is positioned upstream of the color sensor 10 intermediate the color sensor and the nip device 6 for sensing the textile web 1 generally at its central region 15.

The computer 14 is configured to coordinate the moisture sensing information received from the moisture sensor 9 and the color sensing information received from the color sensor 10. For example, the computer 14 can be configured to evaluate the moisture sensing information received from the moisture sensor 9 based upon its sensing of the leading portion of the textile web 1 and, based upon its evaluation of this information, the computer 14 can control the width of the nip 7 to an appropriate value based upon empirical information or practical experience concerning the relation between the moisture sensing information received from the moisture sensor 9 and the distributions of color which correspondingly result from the various moisture contents levels. Following its initial setting of the width of the nip 7 in response to the moisture sensing information, the computer 14 can evaluate the color sensing information received from the color sensor 10 to selectively adjust the width of the nip 7 in response to the color sensing information and thereby adjust the liquor pick up by the textile web.

The color sensor 10 can be configured to sense a color characteristic of the textile web 1 in either an absolute manner or a relative manner. If the color sensor 10 is configured to sense the color characteristic in an absolute manner, the color sensor 10 transmits a signal to the computer 14 which varies in correspondence to the amount of the difference of the sensed color characteristic from a predetermined absolute value. Alternatively, if the color sensor 10 is configured to relatively sense the color characteristic, the color sensor 10 transmits a signal to the computer 14 which corresponds to changes in intensity or presence of the color characteristic sensed by the color sensor.

The computer 14 can evaluate the differences in the signals received from the color sensor 10 relating to the color sensing of the textile web at the respective side locations 16, 17 and the center location 15 to identify variations in the sensed color characteristic at each of the three sensing locations. For example, the computer 14 can evaluate a relatively stronger sensing signal received from the color sensor 10 at the center region 15 as an indication that the distribution of color on the textile web 1 is uneven across its width and, in particular, as an indication that the center region of the textile web 1 will ultimately have too high an intensity of color when the textile web 1 is dried and that the side regions 16, 17 will ultimately have too low a color intensity when the textile web 1 is dried. The computer 14 can then selectively adjust the width of the nip 7 across its width in a conventional manner in response to this evaluation of the color sensing signals to dispose the portion of the textile web 1 which trails the sensed portion at an initial moisture content which facilitates a more desirable uniform color distribution across its width.

The computer 14 can also be configured to operate in a conventional manner to store information relating to the duration of each type of color sensing signal and/or moisture sensing signal received from the color sensor 10 and the moisture sensor 9, respectively, so that this information is available for use, for example, in identifying those portions of the textile web 1 which potentially have color distributions different from the desired color distribution, as predicted by the type of color and/or moisture sensing signal received by the computer 14. For example, the color sensor 10 may sense that a particular portion of the textile web 1 has a color distribution different from an absolute, preferred color distribution and the computer 14 can store information relating to the type and duration of the color sensing signal received from the color sensor 10 during sensing of the particular textile web portion. This information can later be used, for example, by an inspector to locate the respective portion of the textile web which may potentially have ultimately set with a color distribution different from the preferred color distribution.

The combination of the moisture sensing by the moisture sensor 9 and the color sensing by the color sensor 10 can be particularly advantageous, for example, if a relatively large extent of the textile web 1 is to be repetitively dyed during the textile dyeing process. In such a situation, the color sensor 10 can be configured to provide color sensing signals in an absolute manner—that is, to provide color sensing signals corresponding to a selected absolute value, and the computer 14 can be configured to control the width of the nip 7 to a selected width based upon the initial moisture sensing information received from the moisture sensor 9. Then, as the textile web 1 exits the textile padding machine and is sensed by the color sensor 10, the computer 14 can evaluate the color sensing signals received from the color sensor 10 to selectively adjust the width of the nip 7.

Since the feedback system of the present invention automatically adjusts the initial moisture content of the textile web exiting the textile padding machine, the need for intervention by, for example, an operator, is minimized or even eliminated. Since it is typically relatively difficult for an operator to recognize variations in the color distribution of a textile web which has not yet fully dried, the feedback system of the present invention advantageously provides a more reliable means for identifying those portions of a textile web which have a color distribution different from a preferred color distribution.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiment, adaptations, variations, modifications and equivalent arrangements, the present invention being limited only by the claims appended hereto and the equivalents thereof.

We claim:

1. In a textile dyeing process in which a textile web continuously travels through a textile padding machine for the application of dye liquor with the initial dye liquor pick up being controlled by a nip device that removes excess dye liquor from the textile web, resulting in an initial moisture content in the textile web, the improvement comprising:

sensing a color characteristic of the textile web following the removal of excess dye liquor from said textile web portion by the nip device; and controlling the operation of the nip device in response to said color characteristic sensing to control the liquor pick up and thereby control the initial moisture content for desired color distribution on said textile web.

2. In a textile dyeing process, the improvement according to claim 1 and characterized further in that said color characteristic sensing includes sensing the distribution of color on said textile web.

3. In a textile dyeing process, the improvement according to claim 2 and characterized further in that said color distribution sensing includes sensing the color distribution on said textile web at a plurality of sensing locations located across the traveling textile web.

4. In a textile dyeing process, the improvement according to claim 2 and characterized further in that said color distribution sensing includes sensing the absolute color distribution on said textile web.

5. In a textile dyeing process, the improvement according to claim 2 and characterized further in that said color distribution sensing includes sensing the relative color distribution on said textile web.

6. In a textile dyeing process, the improvement according to claim 5 and characterized further in that said sensing the relative color distribution on said textile web includes sensing the color distribution at a plurality of sensing locations located across the traveling textile web and comparing the relative color distributions sensed at said sensing locations, and said controlling the operation of the nip device includes controlling the distribution of the dye liquor pick up across the traveling web.

7. In a textile dyeing process, the improvement according to claim wherein the nip device is controlled to dispose the initial moisture content of the textile web at a predetermined value and characterized further in that said controlling the dye liquor pick up includes adjusting said initial moisture content in response to said color characteristic sensing.

8. In a textile dyeing process, the improvement according to claim 7 wherein a computer is operatively connected to the textile padding machine and a color sensor for sensing said color characteristic is operatively connected to the computer and characterized further in that said adjusting said initial moisture content includes sensing said textile web with said color sensor and transmitting a signal from said color sensor to said computer to prompt said computer to control the nip device to effect adjustment of the initial moisture content of said textile web from said predetermined initial moisture content.

9. In a textile dyeing process, the improvement according to claim and characterized further by storing information by the computer relating to the occurrences of predetermined sensed color characteristics of the textile web, said stored information being retrievable to identify those portions of the textile web having said predetermined sensed color characteristics.

10. In a textile dyeing arrangement having a textile padding machine for applying dye liquor to a textile web continuously traveling therethrough with the initial dye liquor pick up being controlled by a nip device that removes excess dye liquor from the textile web, resulting in an initial moisture content in the textile web, a feedback control system comprising:

means for sensing a color characteristic of the textile web following the removal of excess dye liquor from said textile web portion by the nip device; and means for controlling the operation of the nip device in response to said color characteristic sensing to control the liquor pick up and thereby control the initial moisture content for desired color distribution on said textile web.

11. In a textile dyeing arrangement, the feedback control system according to claim 10 and characterized further in that said color characteristic sensing means includes means for sensing the distribution of color on said textile web.

12. In a textile dyeing arrangement, the feedback control system according to claim 11 and characterized further in that said color distribution sensing means includes means for sensing the color distribution on said textile web at a plurality of sensing locations located across the traveling textile web.

13. In a textile dyeing arrangement, the feedback control system according to claim 11 and characterized further in that said color distribution sensing means includes means for sensing the absolute color distribution on said textile web.

14. In a textile dyeing arrangement, the feedback control system according to claim 11 and characterized further in that said color distribution sensing means includes means for sensing the relative color distribution on said textile web.

15. In a textile dyeing arrangement, the feedback control system according to claim 14 and characterized further in that said means for sensing the relative color distribution on said textile web includes means for sensing the color distribution at a plurality of sensing locations located across the traveling textile web and means for comparing the relative color distributions sensed at said sensing locations, and said means for controlling the operation of the nip device includes means for controlling the distribution of the dye liquor pick up across the traveling web.

16. In a textile dyeing arrangement, the feedback control system according to claim 10 wherein the nip device is controlled to dispose the initial moisture content of the textile web at a predetermined value and characterized further in that said means for controlling the operation of the nip device includes means for adjusting said initial moisture content in response to said color characteristic sensing.

17. In a textile dyeing arrangement, the feedback control system according to claim 16 and characterized further by a computer which is operatively connected to the textile padding machine and characterized further in that said means for adjusting said initial moisture content includes a color sensor operatively connected to said computer for transmitting a signal from said color sensor to said computer to prompt said computer to control the nip device to effect adjustment of the initial moisture content of said textile web from said predetermined initial moisture content.

* * * * *